US010480466B2

(12) United States Patent
Tomitsuka et al.

(10) Patent No.: US 10,480,466 B2
(45) Date of Patent: Nov. 19, 2019

(54) DIAPHRAGM AND PULSATION DAMPER USING SAME

(71) Applicants: FUJIKOKI CORPORATION, Tokyo (JP); DENSO CORPORATION, Aichi (JP)

(72) Inventors: Masahiro Tomitsuka, Tokyo (JP); Shin Yoshida, Tokyo (JP); Makoto Sudo, Tokyo (JP); Akinori Nanbu, Tokyo (JP); Osamu Hishinuma, Aichi (JP); Hiroatsu Yamada, Aichi (JP)

(73) Assignees: FUJIKOKI CORPORATION, Tokyo (JP); DENSO CORPORATION, Aichi (JP)

( * ) Notice: Subject to any disclaimer, the term of this patent is extended or adjusted under 35 U.S.C. 154(b) by 208 days.

(21) Appl. No.: 15/533,209

(22) PCT Filed: Nov. 24, 2015

(86) PCT No.: PCT/JP2015/082936
§ 371 (c)(1),
(2) Date: Jun. 5, 2017

(87) PCT Pub. No.: WO2016/093054
PCT Pub. Date: Jun. 16, 2016

(65) Prior Publication Data

US 2017/0335810 A1 Nov. 23, 2017

(30) Foreign Application Priority Data

Dec. 12, 2014 (JP) ..... 2014-251675

(51) Int. Cl.
*F02M 37/00* (2006.01)
*F02M 59/36* (2006.01)
*F02M 59/44* (2006.01)

(52) U.S. Cl.
CPC ..... *F02M 37/0041* (2013.01); *F02M 59/36* (2013.01); *F02M 59/44* (2013.01)

(58) Field of Classification Search
CPC ..... F02M 37/0041; F02M 59/36; F02M 59/44
(Continued)

(56) References Cited

U.S. PATENT DOCUMENTS 3,628,573 A * 12/1971 Loliger ..... F16L 55/052 137/593
3,862,708 A * 1/1975 Waxlax ..... B67C 3/02 138/30

(Continued)

FOREIGN PATENT DOCUMENTS

JP 2003-083199 A 3/2003
JP 2003-254191 A 9/2003

(Continued)

OTHER PUBLICATIONS

Office Action for corresponding Japanese App. No. 2014-251675, dated May 15, 2018 (with English language machine translation provided by Japan Patent Office).

(Continued)

*Primary Examiner* — Craig M Schneider
*Assistant Examiner* — David R Deal
(74) *Attorney, Agent, or Firm* — Renner, Otto, Boisselle & Sklar, LLP

(57) ABSTRACT

A diaphragm includes a flange and a protrusion provided to protrude to one side of the flange, wherein the protrusion has at least two annular curved portions provided annularly on a ceiling portion having a flat surface-like shape and an outer side in a radial direction of the ceiling portion, in a state where pressure on an outer wall side of the protrusion and pressure on an inner wall side of the protrusion are the same, the at least two annular curved portions are each formed to (Continued)

be curved in a cross-section of the diaphragm obtained by cutting the diaphragm by a virtual plane including a center line of the diaphragm, the centers of curvature of the curved portions being arranged at different positions on a side opposite to a protruding direction of the protrusion, and the diaphragm is formed of a sheet metal.

16 Claims, 6 Drawing Sheets

(58) Field of Classification Search
USPC ..... 138/30
See application file for complete search history.

(56) References Cited

U.S. PATENT DOCUMENTS 4,077,882 A * 3/1978 Gangemi ..... A61M 1/3639 210/137
4,315,527 A * 2/1982 Donnenberg ..... F15B 1/106 138/30
5,505,181 A 4/1996 McRae et al.
8,317,501 B2 * 11/2012 Inoue ..... F04B 37/12 417/540
9,765,739 B2 * 9/2017 Kato ..... F02M 59/367
2002/0139426 A1 * 10/2002 Kippe ..... F16L 55/053 138/30
2003/0164161 A1 9/2003 Usui et al.
2007/0107698 A1 5/2007 Usui et al.
2008/0289713 A1 * 11/2008 Munakata ..... F02M 55/04 138/26
2009/0127356 A1 * 5/2009 Junger ..... F02M 47/027 239/585.1
2011/0017332 A1 * 1/2011 Bartsch ..... B60T 8/4068 138/30
2014/0224367 A1 * 8/2014 Mueller ..... F24D 3/1016 138/30
2017/0248110 A1 * 8/2017 Hashida ..... F02M 59/368

FOREIGN PATENT DOCUMENTS

JP 2004-138071 A 5/2004
JP 2007-138805 A 6/2007
JP 2007-309118 A 11/2007
JP 2012-197732 A 10/2012
JP 2015-017583 A 1/2015
WO 2010/106645 A1 9/2010

OTHER PUBLICATIONS

Chinese Office Action for corresponding Chinese Application No. 201580066432.5 dated Sep. 4, 2018 (with English language machine translation obtained from the Global Dossier).
International Search Report for corresponding International Application No. PCT/JP2015/082936 dated Mar. 1, 2016.
Written Opinion for corresponding International Application No. PCT/JP2015/082936 dated Mar. 1, 2016.
Office Action and an English translation thereof, dated Mar. 14, 2019 for corresponding Chinese application No. 201580066432.5 (note: the English translation is an automated machine translation obtained from the Global Dossier).
Japanese Office Action dated Jan. 8, 2019 for correspondnig Japanese application No. 2014-251675 (with automated machine generated English translation obtained from Global Dossier).

* cited by examiner

DIAPHRAGM AND PULSATION DAMPER USING SAME

TECHNICAL FIELD

The present invention relates to a diaphragm and a pulsation damper using the same, and specifically, relates to a diaphragm capable of effectively reducing pulsation caused in a fuel pump, and a pulsation damper using the same.

BACKGROUND ART

Heretofore, in a high pressure fuel pump and the like, a pulsation damper is known in which a diaphragm provided on a low pressure fuel passage supplying fuel to a pressure chamber within a housing body is configured to absorb and reduce pulsation of a fluid introduced to the pressure chamber through a suction passage (refer for example to Patent Literature 1).

According to such conventional pulsation damper, the diaphragm is formed through pressing, such that a protrusion is formed in one direction of a metal plate formed of stainless steel or the like, and such that a ceiling portion (center portion) of the protrusion forms a flat surface parallel to a flange formed on an outer circumference of the diaphragm.

Then, a whole circumference of the diaphragm is welded to a predetermined flat plate (metal plate), or a flat plate is sandwiched between two diaphragms, and the whole circumference of the metal plate and the diaphragms are welded, or the two diaphragms are directly arranged in opposing relationship without providing a metal plate, and the whole circumference thereof is welded, to form the pulsation damper.

At this time, inert gas of helium or nitrogen is filled under a predetermined pressure and sealed in the space confined by the diaphragm and the metal plate, or the space confined by the two diaphragms.

CITATION LIST

Patent Literature

[PTL 1] Japanese Unexamined Patent Application Publication No. 2007-309118

SUMMARY OF INVENTION

Technical Problem

However, according to the pulsation damper as disclosed in Patent Literature 1, there is not enough amount of change of capacity with respect to a pressure loaded from an exterior of the pulsation damper, and there was fear that pulsation (large pressure fluctuation caused by high pressure) may not be sufficiently absorbed in the high pressure pump to which the pulsation damper was applied.

Therefore, the object of the present invention is to provide a diaphragm and a pulsation damper using the same, capable of achieving a large pulsation reduction effect when applied to a fuel pump.

Solution to Problem

In order to achieve the above object, the diaphragm according to the present invention includes a flange, and a protrusion provided to protrude to one side of the flange, wherein the protrusion includes at least two annular curved portions, one annular curved portion being provided on a ceiling portion having a flat surface-like shape in a state where pressure on an outer wall side of the protrusion and pressure on an inner wall side of the protrusion are same, and the other annular curved portion being provided annularly on an outer side in a radial direction of the ceiling portion, and the at least two annular curved portions are each formed to be curved in a cross-section of the diaphragm obtained by cutting the diaphragm by a virtual plane including a center line of the diaphragm, the centers of curvature of the curved portions being arranged at different positions on a side opposite to a protruding direction of the protrusion, and the diaphragm is formed of a sheet metal.

That is, the present inventors have focused on the point that according to the diaphragm disclosed in Patent Literature 1, a ceiling surface of the protrusion is a flat plane parallel with an outer circumference surface of the diaphragm, and that a bottom portion of the outer circumference portion (bottom contour portion) is formed as a single annular curved portion, and the present inventors have devised the present invention through keen examination aimed at absorbing greater pressure fluctuation by changing the shape of the diaphragm.

According to the above-described diaphragm, the protrusion includes a connecting portion configured to connect the at least two annular curved portions together, and the connecting portion can be formed in a linear state inclined with respect to the ceiling portion in a cross-section of the diaphragm obtained by cutting the diaphragm by a virtual line including a center line of the diaphragm in a state where the pressure on the outer side wall of the protrusion and the pressure on the inner wall side of the protrusion are the same.

According further to the above-described diaphragm, the at least two annular curved portions each have a different radius of curvature in the cross-section of the diaphragm obtained by cutting the diaphragm by the virtual line including the center line of the diaphragm.

According to another aspect of the present invention, a diaphragm includes a flange, and a protrusion provided to protrude to one side of the flange, wherein the protrusion includes a curved center portion and at least one annular curved portion provided annularly on an outer side in a radial direction of the ceiling portion, and the curved center portion and the at least one annular curved portions are each formed to be curved in a cross-section of the diaphragm obtained by cutting the diaphragm by a virtual plane including a center line of the diaphragm in a state where a pressure on an outer wall side of the protrusion and a pressure on an inner wall side of the protrusion are the same, the center of curvature of the curved portion being positioned on a side opposite to a protruding direction of the protrusion, and a center of curvature of the curved center portion being positioned on a center line of the diaphragm, and the diaphragm is formed of a sheet metal.

The diaphragm of the present invention can be applied as a pulsation damper, by joining with another member and forming an enclosed space therein. Inert gas is filled in the enclosed space.

At this time, the other member can be a diaphragm having a same shape, a diaphragm having a different shape, or a flat plate and the like.

Advantageous Effects of Invention

In a state where the pulsation damper using the diaphragm according to the present invention is applied to a fuel pump, the amount of change of capacity with respect to the pressure fluctuation can be increased, and a large pulsation reduction effect can be achieved.

DESCRIPTION OF EMBODIMENTS

Figure 1:
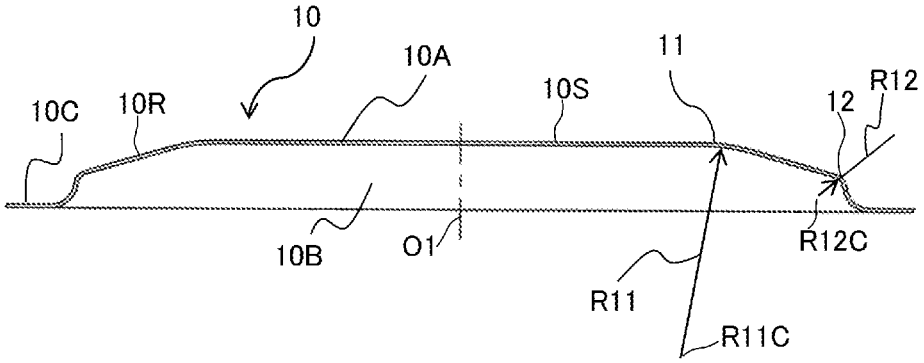
FIG. 1 is a cross-sectional view in which a diaphragm according to a first embodiment of the present invention is cut by a virtual plane including a center line of the diaphragm.
Figure 2:
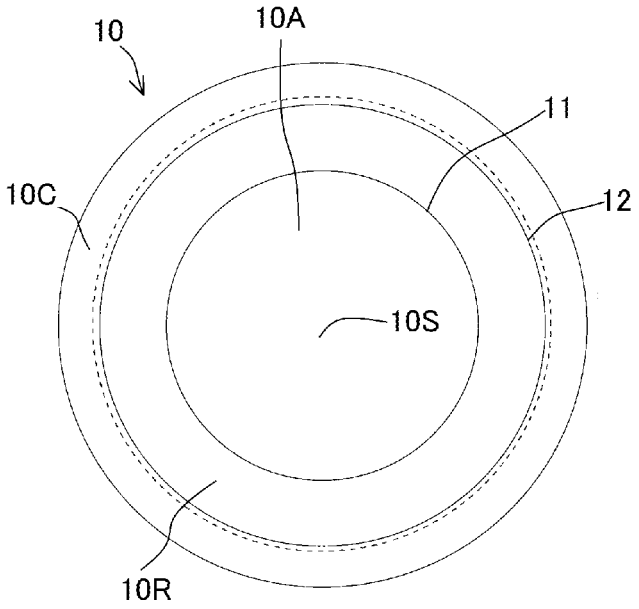
FIG. 2 is a plan view of the diaphragm illustrated in FIG. 1.

FIG. 1 is a cross-sectional view in which a diaphragm 10 according to a first embodiment of the present invention is cut by a virtual plane including a center line (vertical line) 01 of the diaphragm, and FIG. 2 is a plan view of the diaphragm 10 illustrated in FIG. 1. In the following description, the cross-section cut by the virtual plane as illustrated in FIG. 1 is called a "center cross-section".

Generally, a pulsation damper is used in a state where inert gas and the like is sealed with a pressure higher than atmospheric pressure within the protrusion of the diaphragm, but FIGS. 1 and 2 illustrate a state in which gas is not sealed in a protrusion 10A, and a pressure on the outer wall side (protruded side) of the protrusion and pressure on the inner wall side of the protrusion are equal.

As illustrated in FIGS. 1 and 2, the diaphragm 10 according to the first embodiment is formed such that an external shape becomes circular (such that a horizontal cross-section of the respective portions becomes circular) by subjecting a sheet metal such as a stainless steel plate, to plastic processing, such as pressing.

Further, a first annular curved portion 11 in which reference number R11C is set as the center of curvature and a radius of curvature is R11 in the center cross-section of the diaphragm 10, and a second annular curved portion 12 in which reference number R12C is set as the center of curvature and a radius of curvature is R12 in the same cross-section are formed in the diaphragm 10, wherein a center portion (ceiling portion 10S) surrounded by the first annular curved portion 11 is formed to have a planar shape, and thereby, the diaphragm 10 has the protrusion 10A protruding to one direction, and a recessed portion 10B is formed on an opposite side of the protrusion 10A, that is, inner wall side of the protrusion 10A.

In the appearance of the diaphragm, the first annular curved portion 11 and the second annular curved portion 12 are formed as a two-step annular curved portion provided annually on the outer side in the radial direction of the ceiling portion 10S formed in a planar shape.

Further, an annular flange 10C is formed on an outer circumference of the protrusion 10A, and the protrusion 10A is formed to protrude to one side of the annular flange 10C.

A center of curvature R11C of the first annular curved portion 11 and a center of curvature R12C of the second annular curved portion 12 are provided at different positions on a side opposite to the protruding direction of the protrusion 10A (inner wall side of the protrusion 10A).

Further according to the first embodiment, a connecting portion 10R connecting the first annular curved portion 11 and the second annular curved portion 12 is formed such that it has an approximately linear center cross-section, and is inclined with respect to the ceiling portion.

The first embodiment forms two types of annular curved portions (the first annular curved portion 11 and the second annular curved portion 12) in the center cross-section. Therefore, as illustrated in FIG. 1, in a state where a radius of curvature R11 of the first annular curved portion 11 and a radius of curvature R12 of the second annular curved portion 12 are of different dimensions, there is no need to specifically provide the connecting portion 10R. In that case, the center of curvatures R11C and R12C are positioned at different positions.

Moreover, in a state where the radius of curvature R11 of the first annular curved portion 11 and the radius of curvature R12 of the second annular curved portion 12 are of identical dimensions, an inclined plane in a linear state (the connecting portion 10R) is provided, and the center of curvatures R11C and R12C are positioned at different positions.

In the first embodiment, two annular curved portions are formed, but it is possible to form three or more annular curved portions.

Figure 3:
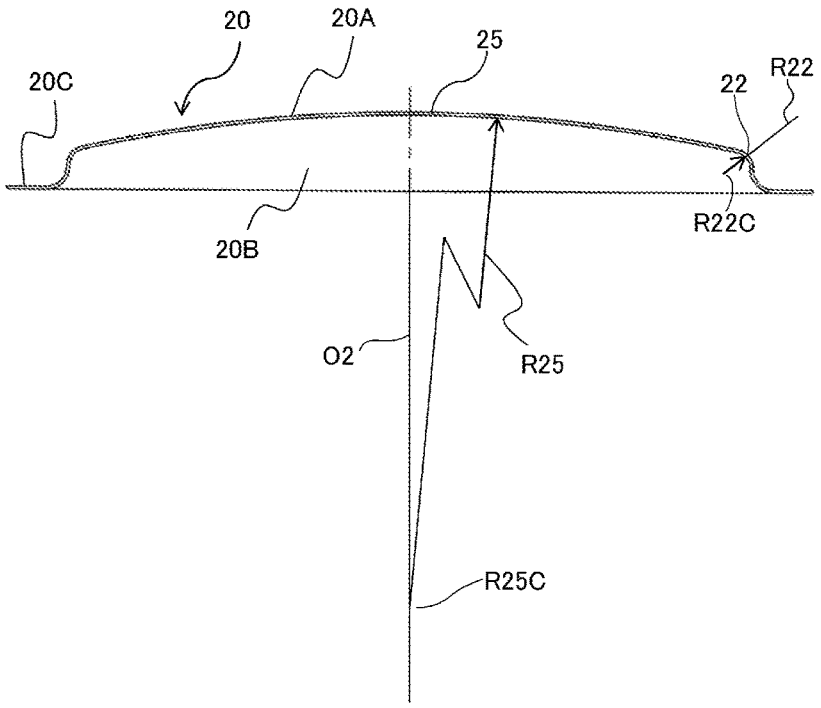
FIG. 3 is a cross-sectional view in which a diaphragm according to a second embodiment of the present invention is cut by a virtual plane including the center line of the diaphragm.
Figure 4:
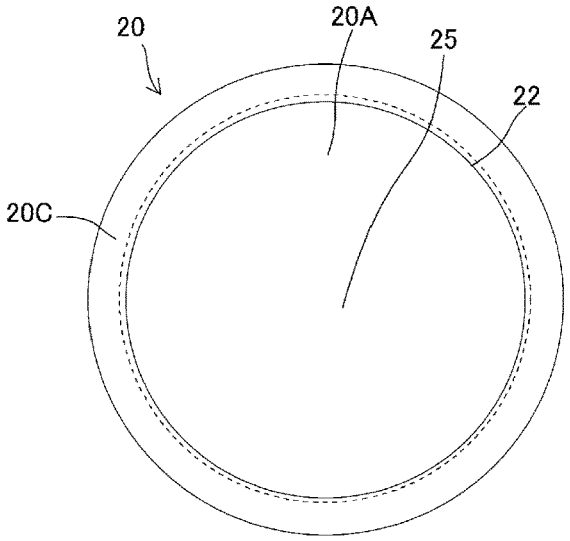
FIG. 4 is a plan view of the diaphragm illustrated in FIG. 3.

FIG. 3 is a cross-sectional view in which a diaphragm 20 according to the second embodiment of the present invention is cut by a virtual plane including a center line O2 thereof, and FIG. 4 is a plan view of the diaphragm 20 illustrated in FIG. 3. Similar to FIGS. 1 and 2, FIGS. 3 and 4 illustrate a state in which gas is not sealed within the protrusion 20A, and pressure on the outer wall side of the protrusion 20A and the pressure on the inner wall side thereof are equal.

Similar to the diaphragm 10 of the first embodiment, the diaphragm 20 is formed such that a horizontal cross-section of the respective portions becomes circular, by subjecting a sheet metal, such as a stainless steel plate, to plastic processing, such as pressing.

Further, a single curved center portion 25 having a center of curvature denoted by reference number R25C at the center portion of the center cross-section and having a large radius of curvature R25, and an annular curved portion 22 provided in a circumference of the curved center portion 25 and having a center of curvature denoted by reference number R22C and a radius of curvature of R22 (smaller than R25) are formed on the diaphragm 20.

Now, in the appearance of the diaphragm 20, the annular curved portion 22 is formed annularly on an outer side in a radial direction of the curved center portion 25. That is, the diaphragm 20 includes the protrusion 20A having a one-step (one) annular bent portion (annular curved portion 22), and a dome-shaped ceiling portion.

Further, an annular flange 20C is formed on an outer circumference of the protrusion 20A, and the protrusion 20A is formed to protrude to one side of the annular flange 20C.

As illustrated in FIGS. 3 and 4, a center of curvature R25C of the curved center portion 25 and a center of curvature R22C of the annular curved portion 22 are provided at different positions on a side opposite to the protruding direction of the protrusion 20A (inner wall side of the protrusion 20A), and the center of curvature R25C of the curved center portion 25 is set to be positioned on the center line O2 of the diaphragm 20.

In the second embodiment, one curved center portion and one annular curved portion are formed, but it is also possible to form one curved center portion and two or more annular curved portions (that is, by adding a curved center portion to the configuration of the diaphragm 10 of FIGS. 1 and 2).

Figure 5:
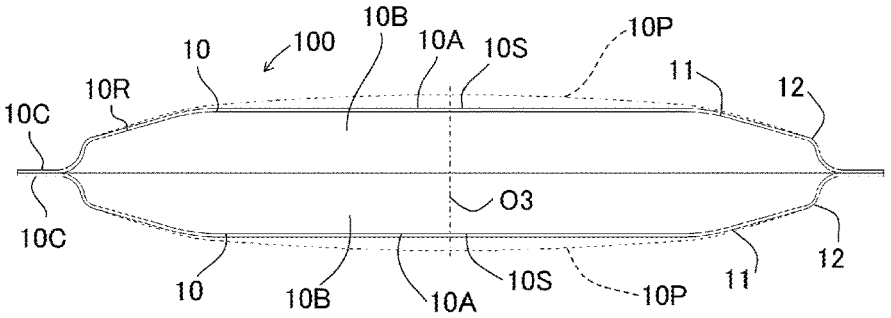
FIG. 5 is a cross-sectional view illustrating one example of a case in which the diaphragm according to the first embodiment of the present invention is applied to a pulsation damper.

FIG. 5 illustrates one example of a case in which the diaphragm according to the first embodiment of the present invention illustrated in FIGS. 1 and 2 is applied to a pulsation damper, and it is a cross-sectional view in which the pulsation damper is cut by a virtual plane including a center line O3 thereof.

As illustrated in FIG. 5, a pulsation damper 100 utilizes two diaphragms 10 illustrated in FIGS. 1 and 2, wherein the diaphragms 10 are superimposed at the respective flanges 10C with the recessed portions 10B facing one another, inert gas such as helium and nitrogen is filled in the inner side thereof under a predetermined pressure and sealed, and the whole circumference of the flanges 10C is welded by laser welding or the like and integrated.

FIG. 5 illustrates a state in which a pressure inside the pulsation damper 100 (charging pressure of inert gas) is equal to the outside pressure, and in a state where the pulsation damper 100 is placed in the atmosphere (that is, in a state where the outside pressure is lower than the internal pressure of the pulsation damper 100), the center portion of the damper will be expanded, as illustrated by the dashed lines denoted by reference number 10P.

The pulsation damper 100 illustrated in FIG. 5 can be used for the purpose of reducing a pressure pulsation within the pump, by attaching to a fuel passage such as a fuel pump, as illustrated in Patent Literature 1 described earlier.

In this case, since a plurality of annular curved portions are formed according to the embodiment of FIG. 5, the amount of deformation during operation of the pulsation damper (during deformation by pulsation) is increased and the effect of preventing pulsation of the pulsation damper is improved, compared to a case where there is only one annular curved portion as illustrated in Patent Literature 1.

Now, in a state where a plurality of annular curved portions are formed to be positioned alternately on both sides, on a protruding direction of the protrusion (outer wall direction) and on a direction opposite to the protruding direction (inner wall direction) of the diaphragm (that is, in a state where the diaphragm is curved with concavity and convexity), there is fear that curvature is increased (that is, the radius of curvature is reduced) at a curved portion in which the center of curvature is positioned in the protruding direction of the diaphragm during operation of the pulsation damper, especially in a state where the outer pressure is higher than the charging pressure of the inert gas, and stress may concentrate on these annular curved portions, such that the durability of the pulsation damper is deteriorated.

However, according to the embodiment illustrated in FIG. 5, a center of curvatures of the plurality of annular curved portions 11 and 12 are positioned at the direction opposite to the protruding direction of the protrusion of the diaphragm, such that even in a state where the external pressure is higher than the charging pressure of inert gas, the radius of curvatures of the annular curved portions 11 and 12 will not be reduced, and both the effect of preventing pulsation of the pulsation damper and the durability hereof tare improved.

Figure 6:
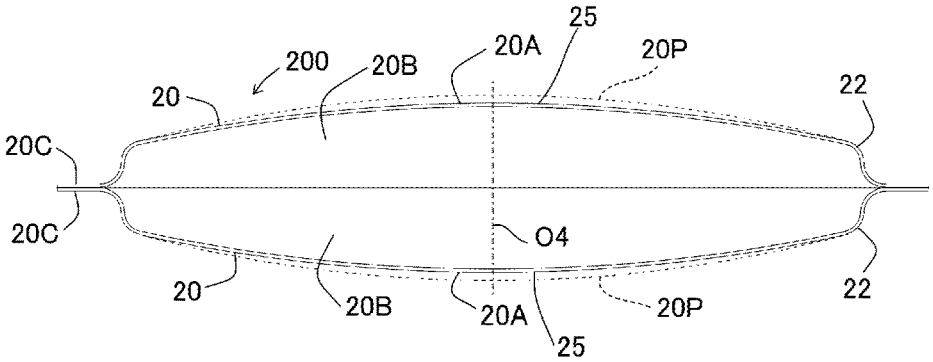
FIG. 6 is a cross-sectional view illustrating one example of a state in which the diaphragm according to the second embodiment of the present invention is applied to a pulsation damper.

FIG. 6 illustrates one example of a case in which the diaphragm according to the second embodiment of the invention illustrated in FIGS. 3 and 4 is applied to a pulsation damper, and it is a cross-sectional view in which the pulsation damper is cut by a virtual plane including a center line O4 thereof.

A pulsation damper 200 utilizes two diaphragms 20 illustrated in FIGS. 3 and 4, wherein the diaphragms 20 are superimposed at the respective flanges 20C with the recessed portions 20B facing one another, inert gas such as helium and nitrogen is filled in the inner side thereof under a predetermined pressure and sealed, and the whole circumference of the flanges 20C is welded by laser welding or the like and integrated.

FIG. 6 also illustrates a state in which a pressure inside the pulsation damper 200 is equal to the outside pressure, and in a state where the pulsation damper 200 is placed in the atmosphere, the center portion of the damper will be expanded, as illustrated by the dashed lines denoted by reference number 20P.

The pulsation damper 200 formed as described can also be used for the purpose of reducing the pressure pulsation within the pump, by attaching to a fuel passage such as a fuel pump. In that case, since one curved center portion 25 is formed at a center of one annular curved portion 22 according to the embodiment of FIG. 6, similar to the embodiment of FIG. 5, the amount of deformation during operation of the pulsation damper is increased and the effect of preventing pulsation of the pulsation damper is improved, compared to the case illustrated in Patent Literature 1.

According further to the pulsation damper 200, the curved center portion 25 is provided to the protrusion 20A of the diaphragm 20 and is curved in advance to the outer side, such that compared to the case of Patent Literature 1 in which the diaphragm has a flat center portion, the amount of deformation (amount of change of capacity within pulsation damper) is small in a state where the external pressure is smaller than the charging pressure, and in a state where the external pressure is greater than the charging pressure, the diaphragm curves in an opposite direction as the direction curved to the outer side in advance, such that the amount of change of capacity is increased at least corresponding to the capacity curved to the outer side in advance.

If the amount of change of the pulsation damper is increased in a state where pulsation of a predetermined pressure or greater occurs, since the effect to prevent pulsation is high, the effect of preventing pulsation corresponding to the predetermined pulsation pressure can be improved even further by adjusting the charging pressure of inert gas filled inside the pulsation damper 200.

FIGS. 7 through 11 are cross-sectional views illustrating a modified example in which the diaphragm according to the first embodiment of the present invention is applied to a pulsation damper, in which the pulsation chamber is cut by virtual planes including respective center lines O5 through O9. In FIGS. 7 through 11, the same reference numbers as FIGS. 1 and 2 illustrate identical or equivalent portions. FIGS. 7 through 11 also illustrate a state in which the pressure inside the pulsation damper and the external pressure are equal, and when the pulsation damper is placed in the atmosphere, the center shape is expanded as illustrated by the dashed lines of reference numbers 10P and 90P.

Figure 7:
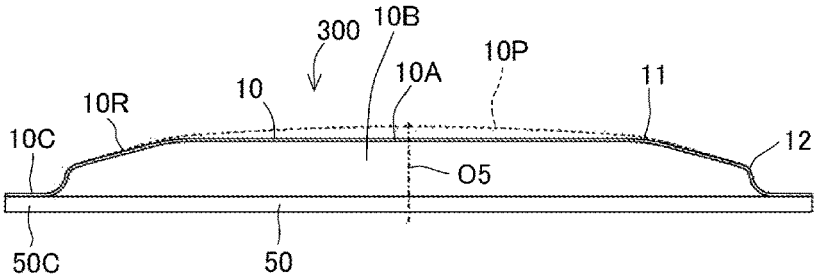
FIG. 7 is a cross-sectional view illustrating a modified example in which the diaphragm according to the first embodiment of the present invention is applied to a pulsation damper.

A pulsation damper 300 as illustrated in FIG. 7 has the diaphragm 10 illustrated in FIGS. 1 and 2 superposed on a disk-shaped support plate 50 formed, for example, of a stainless steel plate, inert gas such as helium or nitrogen is sealed therein under a predetermined pressure, then the whole circumference of the flange 10C and the support plate 50 are welded, for example, by laser welding and integrated.

Figure 8:
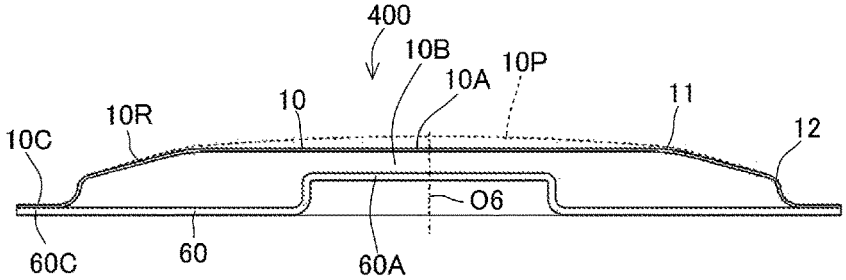
FIG. 8 is a cross-sectional view illustrating another modified example in which the diaphragm according to the first embodiment of the present invention is applied to a pulsation damper.

According to a pulsation damper 400 illustrated in FIG. 8, a dented portion 60A is formed at a center of a disk-shaped support plate 60, the support plate 60 and the diaphragm 10 are superposed in a state where the dented portion 60A is arranged within the recessed portion 10B of the diaphragm 10, and inert gas such as helium or nitrogen is sealed therein under a predetermined pressure, then the whole circumference of the flange 10C and an outer circumference portion 60C of the support plate 50 are welded, for example, by laser welding and integrated.

The present modified example is an example where the internal capacity of the pulsation damper 300 illustrated in FIG. 7 is reduced, and simply by adjusting the contour, that is, capacity, of the dented portion 60A, the characteristics (pulsation absorption characteristics) required in the pulsation damper 400 can be achieved using a common diaphragm 10.

Figure 9:
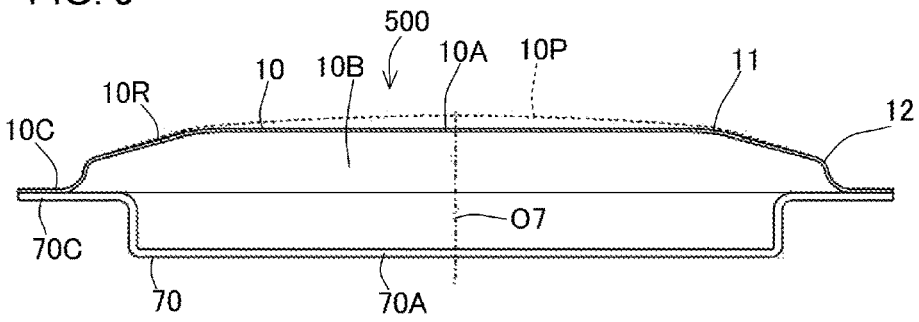
FIG. 9 is a cross-sectional view illustrating yet another modified example in which the diaphragm according to the first embodiment of the present invention is applied to a pulsation damper.

According to a pulsation damper 500 illustrated in FIG. 9, a projected portion 70A is formed at a center of a disk-shaped support plate 70, the support plate 70 and the diaphragm 10 being superposed in a state where the projected portion 60A is positioned on an opposite side as the recessed portion 10B of the diaphragm 10, and inert gas such as helium or nitrogen is sealed therein under a predetermined pressure, wherein the whole circumference of the flange 10C and an outer circumference portion 70C of the support plate 70 are welded, for example, by laser welding and integrated.

In contrast to the case of FIG. 8, the present modified example has increased the internal capacity of the pulsation damper 300 illustrated in FIG. 7. Similarly according to the present modified example, the characteristics required in the pulsation damper 500 can be achieved using a common diaphragm 10, simply by adjusting the capacity of the projected portion 70A.

Figure 10:
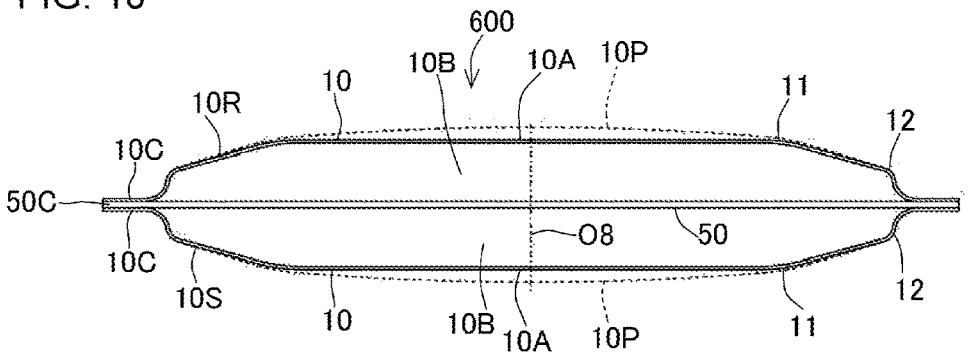
FIG. 10 is a cross-sectional view illustrating yet another modified example in which the diaphragm according to the first embodiment of the present invention is applied to a pulsation damper.

According to a pulsation damper 600 illustrated in FIG. 10, the diaphragms 10 illustrated in FIGS. 1 and 2 are arranged on both sides of the support plate 50 illustrated in FIG. 7 and superposed, and inert gas such as helium or nitrogen is sealed therein under a predetermined pressure, then the whole circumference of the flange 10C and the outer circumference portion 50C of the support plate 50 are welded, for example, by laser welding and integrated.

The present modified example is equivalent to a configuration where two sets of the pulsation damper 300 illustrated in FIG. 7 are superposed. The present modified example can be adopted according to the property required in the pulsation damper.

As described, the pulsation damper can be composed of the diaphragm 10 and the thin plate.

Figure 11:
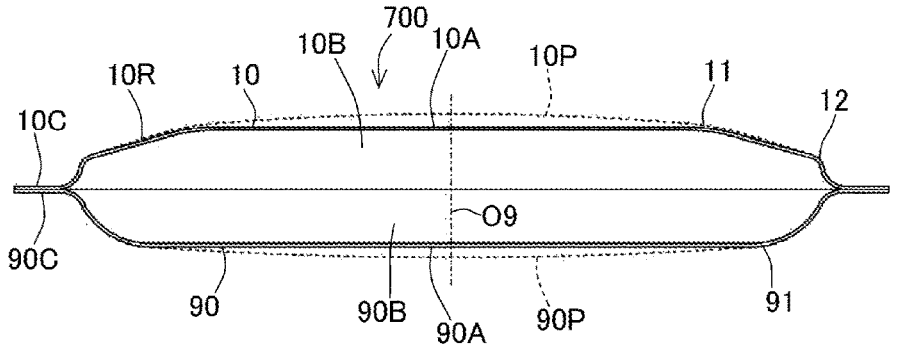
FIG. 11 is a cross-sectional view illustrating yet another modified example in which the diaphragm according to the first embodiment of the present invention is applied to a pulsation damper.

A pulsation damper 700 illustrated in FIG. 11 is configured of the diaphragm 10 illustrated in FIGS. 1 and 2, and a diaphragm 90 having a different shape. In other words, only one annular curved portion 91 is provided to the diaphragm 90, and in a state where the pressure inside the pulsation damper and the external pressure are equal, a center portion of a protrusion 90A of the diaphragm 90 (area surrounded by the annular curved portion 91) is flat.

The flange 10C of the diaphragm 10 and a flange 90C of the diaphragm 90 are superposed in a state where the recessed portions 10B and 90B are opposed, and inert gas such as helium or nitrogen is sealed therein under a predetermined pressure, then the whole circumference of the flanges 10C and 90C are welded, for example, by laser welding, such that the diaphragms 10 and 90 are integrated.

The present modified example can also be adopted according to the characteristics required in the pulsation damper.

The cases illustrated in FIGS. 7 through 11 all utilize the diaphragm 10 illustrated in FIGS. 1 and 2, but of course, the diaphragm 20 illustrated in FIGS. 3 and 4 can be utilized instead of the diaphragm 10.

Further, it is also possible to weld the diaphragm 10 illustrated in FIGS. 1 and 2 and the diaphragm 20 illustrated in FIGS. 3 and 4 to form the pulsation damper.

Figure 12:
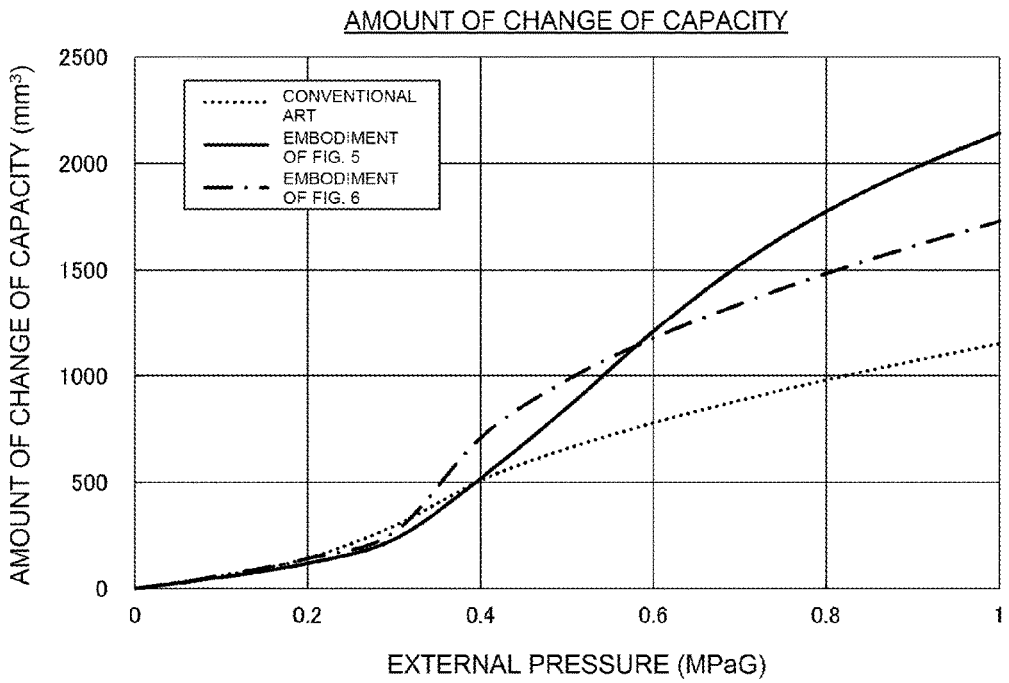
FIG. 12 is a graph illustrating the characteristics of a pulsation damper utilizing the diaphragms according to the first and second embodiments of the present invention illustrated in FIGS. 1 and 3.
Figure 13:
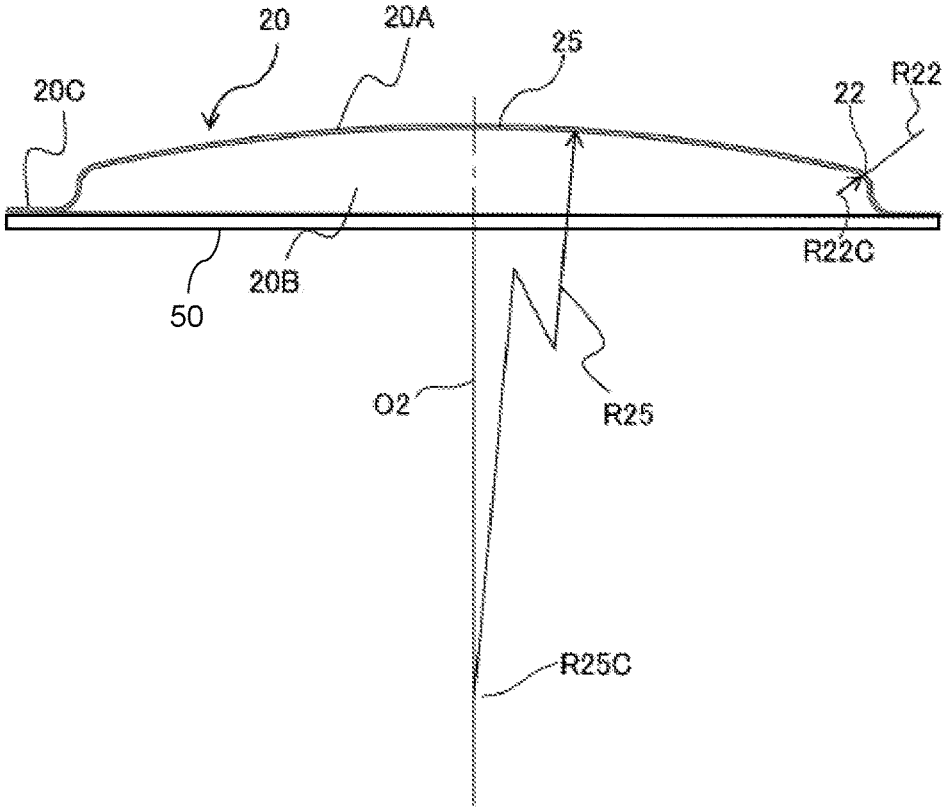
FIG. 13 is a cross-sectional view illustrating a modified example in which the diaphragm according to the second embodiment of the present invention is applied to a pulsation damper.

FIG. 12 is a graph illustrating the characteristics of the pulsation damper illustrated in FIGS. 5 and 6 configured using the diaphragms of the first and second embodiments (illustrated in FIGS. 1 and 3), and the characteristics of a conventional pulsation damper, wherein a solid line illustrates the characteristics of the pulsation damper illustrated in FIG. 5, a dotted-dashed line illustrates the characteristics of the pulsation damper illustrated in FIG. 6, and a dashed line illustrates the characteristics of the conventional pulsation damper.

The characteristics of a conventional product relates to a product having one annular curved portion and a planar area surrounded by the annular curved portion (ceiling portion). Further, the measurement is performed by applying a predetermined repeated fluctuated pressure (pulsation pressure) to the pulsation damper, and measuring the amount of change of capacity of the pulsation damper that occurs during application of the repeated fluctuated pressure.

The characteristics of the pulsation damper obtained by such measurement method is determined to have a higher evaluation if the amount of change of capacity of the damper is greater in a state where the same external pressure value is applied.

As illustrated in FIG. 12, in a state where a horizontal axis indicates an external pressure of the circumference of the pulsation damper and a vertical axis shows an amount of change of capacity of the pulsation damper, within a range in which the external pressure is approximately 0.4 to 1.0 MPa, the pulsation dampers illustrated in FIGS. 5 and 6 both have greater amount of change of capacity compared to the conventional product, so that the performance as a damper is highly evaluated.

Especially in a state where the external pressure is in the range of 0.8 MPa or greater, the pulsation damper of FIG. 5 having two annular curved portions enables to achieve approximately 1.8 times the amount of change of capacity compared to the conventional pulsation damper having only one annular curved portion, and the pulsation damper of FIG. 6 having one curved center portion and one annular curved portion provided on the circumference of the center portion enables to achieve approximately 1.5 times the amount of change of capacity.

Further, based on additional tests, it has been found that even in a state where the number of the annular curved portions is the same, the amount of change of capacity of the pulsation damper or the change of characteristics thereof can be adjusted appropriately by changing the position of the center of curvature of the annular curved portion or the radius of curvature (the results are not shown).

Therefore, the required amount of change of capacity and durability can be achieved in a state where the diaphragm is applied to a pulsation damper, by appropriately selecting the number of annular curved portions, the position of the center of curvature and the radius of curvature in the diaphragm of the present invention.

REFERENCE SIGNS LIST

10, 20, 90 Diaphragm
10A, 20A, 90A Protrusion
10B, 20B 90B Recessed potion
10C, 20C, 90C Flange
11, 12 First and second annular curved portions
22 Annular curved portion
25 Curved center portion
100, 200, 300, 400, 500, 600, 700 Pulsation damper
R11, R12 Radius of curvatures of first and second annular curved portions
R11C, R12C Center of curvatures of first and second annular curved portions
R22 Radius of curvature of annular curved portion
R22C Center of curvature of annular curved portion
R25 Radius of curvature of curved center portion
R25C Center of curvature of curved center portion

The invention claimed is:

1. A diaphragm comprising a flange, and a protrusion provided to protrude to one side of the flange, wherein the protrusion comprises at least two annular curved portions provided annularly on a ceiling portion having a flat surface-like shape and on an outer side in a radial direction of the ceiling portion, in a state where pressure on an outer wall side of the protrusion and pressure on an inner wall side of the protrusion are the same, the at least two annular curved portions are each formed to be curved in a cross-section of the diaphragm obtained by cutting the diaphragm by a virtual plane including a center line of the diaphragm, and centers of curvature of the at least two annular curved portions are all arranged at different positions on a side opposite to a protruding direction of the protrusion, the protrusion has a concave curved shape only on an inner wall surface among an outer wall surface and the inner wall surface of the protrusion over the entire area from the outermost one of the at least two annular curved portions to the center line of the diaphragm, the diaphragm further comprises an annular rising portion provided between the flange and the protrusion, the annular rising portion curvilinearly rising from the flange to the protrusion and having a curvature radius in the cross-section of the diaphragm larger than that of the outermost one of the at least two annular curved portions, and the diaphragm is formed of a sheet metal.

2. The diaphragm according to claim 1, wherein the protrusion comprises a connecting portion configured to connect the at least two annular curved portions together, and the connecting portion is formed to be in a linear state inclined with respect to the ceiling portion in a cross-section of the diaphragm obtained by cutting the diaphragm by a virtual line including a center line of the diaphragm in a state where the pressure on the outer wall side of the protrusion and the pressure on the inner wall side of the protrusion are the same.

3. The diaphragm according to claim 2, wherein the at least two annular curved portions each have a different radius of curvature in the cross-section of the diaphragm obtained by cutting the diaphragm by the virtual line including the center line of the diaphragm.

4. A diaphragm comprising a flange, and a protrusion provided to protrude to one side of the flange, wherein the protrusion comprises a curved center portion and at least one annular curved portion provided annularly on an outer side in a radial direction of the curved center portion, the curved center portion and the at least one annular curved portion are each formed to be curved in a cross-section of the diaphragm obtained by cutting the diaphragm by a virtual plane including a center line of the diaphragm in a state where a pressure on an outer wall side of the protrusion and a pressure on an inner wall side of the protrusion are the same, centers of curvature of the curved center portion and the at least one annular curved portion are all positioned on a side opposite to a protruding direction of the protrusion, and the center of curvature of the curved center portion is positioned on a center line of the diaphragm, the protrusion has a concave curved shape only on an inner wall surface among an outer wall surface and the inner wall surface of the protrusion over the entire area from the outermost one of the at least one annular curved portion to the center line of the diaphragm, the diaphragm further comprises an annular rising portion provided between the flange and the protrusion, the annular rising portion curvilinearly rising from the flange to the protrusion and having a curvature radius in the cross-section of the diaphragm larger than that of the outermost one of the at least one annular curved portion, and the diaphragm is formed of a sheet metal.

5. A pulsation damper comprising two diaphragms, each diaphragm formed of a sheet metal and comprising a flange and a protrusion provided to protrude to one side of the flange, the two diaphragms joined by the flanges and forming an enclosed space, wherein the protrusion comprises at least two annular curved portions provided annularly on a ceiling portion having a flat surface-like shape and on an outer side in a radial direction of the ceiling portion, in a state where pressure on an outer wall side of the protrusion and pressure on an inner wall side of the protrusion are the same, the at least two annular curved portions are each formed to be curved in a cross-section of the diaphragm obtained by cutting the diaphragm by a virtual plane including a center line of the diaphragm, and centers of curvature of the at least two curved portions are all arranged at different positions on a side opposite to a protruding direction of the protrusion, the protrusion has a concave curved shape only on an inner wall surface among an outer wall surface and the inner wall surface of the protrusion over the entire area from the outermost one of the at least two annular curved portions to the center line of the diaphragm, and the diaphragm further comprises an annular rising portion provided between the flange and the protrusion, the annular rising portion curvilinearly rising from the flange to the protrusion and having a curvature radius in the cross-section of the diaphragm larger than that of the outermost one of the at least two annular curved portions.

6. The pulsation damper according to claim 5, wherein the two diaphragms have mutually different shapes.

7. The pulsation damper according to claim 6, wherein the enclosed space is filled with inert gas.

8. A pulsation damper comprising two diaphragms, each diaphragm formed of a sheet metal and comprising a flange and a protrusion provided to protrude to one side of the flange, the two diaphragms joined by the flanges and forming an enclosed space, wherein the protrusion comprises a curved center portion and at least one annular curved portion provided annularly on an outer side in a radial direction of the curved center portion, the curved center portion and the at least one annular curved portion are each formed to be curved in a cross-section of the diaphragm obtained by cutting the diaphragm by a virtual plane including a center line of the diaphragm in a state where a pressure on an outer wall side of the protrusion and a pressure on an inner wall side of the protrusion are the same, and centers of curvature of the curved portion and the at least one annular curved portion are all positioned on a side opposite to a protruding direction of the protrusion, and the center of curvature of the curved center portion is positioned on the center line of the diaphragm, the protrusion has a concave curved shape only on an inner wall surface among an outer wall surface and the inner wall surface of the protrusion over the entire area from the outermost one of the at least one annular curved portion to the center line of the diaphragm, and the diaphragm further comprises an annular rising portion provided between the flange and the protrusion, the annular rising portion curvilinearly rising from the flange to the protrusion and having a curvature radius in the cross-section of the diaphragm larger than that of the outermost one of the at least one annular curved portion.

9. The pulsation damper according to claim 8, wherein the two diaphragms have mutually different shapes.

10. The pulsation damper according to claim 9, wherein the enclosed space is filled with inert gas.

11. A pulsation damper comprising a diaphragm formed of a sheet metal and an other member that differs from the diaphragm, the diaphragm comprising a flange and a protrusion provided to protrude to one side of the flange, the diaphragm and the other member being superposed and joined by the flanges and forming an enclosed space, wherein the protrusion comprises at least two annular curved portions provided annularly on a ceiling portion having a flat surface-like shape and on an outer side in a radial direction of the ceiling portion, in a state where pressure on an outer wall side of the protrusion and pressure on an inner wall side of the protrusion are the same, the at least two annular curved portions are each formed to be curved in a cross-section of the diaphragm obtained by cutting the diaphragm by a virtual plane including a center line of the diaphragm, and centers of curvature of the at least two annular curved portions are all arranged at different positions on a side opposite to a protruding direction of the protrusion, the protrusion has a concave curved shape only on an inner wall surface among an outer wall surface and the inner wall surface of the protrusion over the entire area from the outermost one of the at least two annular curved portions to the center line of the diaphragm, and the diaphragm further comprises an annular rising portion provided between the flange and the protrusion, the annular rising portion curvilinearly rising from the flange to the protrusion and having a curvature radius in the cross-section of the diaphragm larger than that of the outermost one of the at least two annular curved portions.

12. The pulsation damper according to claim 11, wherein the other member is a flat plate.

13. The pulsation damper according to claim 12, wherein the enclosed space is filled with inert gas.

14. A pulsation damper comprising a diaphragm formed of a sheet metal and an other member that differs from the diaphragm, the diaphragm comprising a flange and a protrusion provided to protrude to one side of the flange, the diaphragm and the other member being superposed and joined by the flanges and forming an enclosed space, the protrusion comprises a curved center portion and at least one annular curved portion provided annularly on an outer side in a radial direction of the curved center portion, the curved center portion and the at least one annular curved portion are each formed to be curved in a cross-section of the diaphragm obtained by cutting the diaphragm by a virtual plane including a center line of the diaphragm in a state where a pressure on an outer wall side of the protrusion and a pressure on an inner wall side of the protrusion are the same, and centers of curvature of the curved center portion and the at least one annular curved portion are all positioned on a side opposite to a protruding direction of the protrusion, and the center of curvature of the curved center portion is positioned on the center line of the diaphragm, the protrusion has a concave curved shape only on an inner wall surface among an outer wall surface and the inner wall surface of the protrusion over the entire area from the outermost one of the at least one annular curved portion to the center line of the diaphragm, and the diaphragm further comprises an annular rising portion provided between the flange and the protrusion, the annular rising portion curvilinearly rising from the flange to the protrusion and having a curvature radius in the cross-section of the diaphragm larger than that of the outermost one of the at least one annular curved portion.

15. The pulsation damper according to claim 14, wherein the other member is a flat plate.

16. The pulsation damper according to claim 15, wherein the enclosed space is filled with inert gas.

* * * * *